United States Patent [19]

Garkusha et al.

[11] 4,398,865

[45] Aug. 16, 1983

[54] EXHAUST PIPE OF TURBINE

[76] Inventors: Anatoly V. Garkusha, ulitsa 23 Avgusta 63, kv. 82; Vladimir E. Dobrynin, pereulok Zernovoi, 6/4, kv. 49, both of Kharkov, U.S.S.R.

[21] Appl. No.: 197,771

[22] PCT Filed: Nov. 6, 1979

[86] PCT No.: PCT/SU79/00110

§ 371 Date: Jul. 10, 1980

§ 102(e) Date: Jun. 30, 1980

[87] PCT Pub. No.: WO80/00989

PCT Pub. Date: May 15, 1980

[30] Foreign Application Priority Data

Nov. 10, 1978 [SU] U.S.S.R. ..... 2684832

[51] Int. Cl.[3] ..... F01D 17/14

[52] U.S. Cl. ..... 415/148

[58] Field of Search ..... 415/148, 150, 163, 159, 415/160, 157, 155, 151; 5/451

[56] References Cited

U.S. PATENT DOCUMENTS

| | | | |
|---|---|---|---|
| 2,810,545 | 10/1957 | Buchi | 415/148 |
| 3,168,238 | 2/1965 | Carrigan | 415/148 |

FOREIGN PATENT DOCUMENTS

| | | | |
|---|---|---|---|
| 733286 | 3/1943 | Fed. Rep. of Germany | 415/148 |
| WO80/01093 | 5/1980 | PCT Int'l Appl. | 415/157 |
| 704856 | 3/1954 | United Kingdom | 415/160 |
| 487242 | 5/1975 | U.S.S.R. . | |

*Primary Examiner*—Leonard E. Smith

*Attorney, Agent, or Firm*—McAulay, Fields, Fisher, Goldstein & Nissen

[57] ABSTRACT

The exhaust pipe of a turbine accommodates in the inner portion (3) thereof a guide (8). The inner side surface of the guide (8) is essentially the surface of a body of revolution about an axis coincident with the axis (6) of the turbine. The guide (8) is disposed so that one of its ends (9) adjoins the outer ends (10) of the blades (4) of the runner (5) of the turbine. In accordance with the invention, the guide (8) is adapted to vary the area of the flow cross-section of the inlet portion (3) of the exhaust pipe.

20 Claims, 6 Drawing Figures

EXHAUST PIPE OF TURBINE

FIELD OF THE INVENTION

The present invention relates to turbine engineering, and, more particularly, it relates to an exhaust pipe for a turbine.

BACKGROUND OF THE INVENTION

Known in the art is an exhaust pipe for a steam turbine, comprising in the inlet portion thereof a guide or baffle having a tapered inner surface is tapering, its axis coinciding with the longitudinal axis of the turbine, i.e. with the axis of rotation of the rotor. The guide is mounted so that the end of its smaller diameter adjoins the outer ends of the blades of the runner of the last stage of the turbine, while its other end, which has a larger diameter, is disposed at the outlet of the inlet portion of the exhaust pipe (cf. "Steam Turbine Plants of Nuclear Power Stations", ENERGIYA Publishers, Moscow, U.S.S.R., 1978, pp. 176–177).

However, this known exhaust pipe with the tapering guide would not provide for stable performance of the last stage of the turbine when the operating conditions of the latter varies significantly from the nominal one, i.e. from the duty at at which the turbine has been designed to yield the maximum economy.

When the flow rate by volume of the working fluid varies, e.g. where the working fluid is steam, and/or when the angular speed of the rotor rotation varies, the flow entering a exhaust pipe attains the swirling condition, i.e. the greater the increase in the circumferential and radial components of the working fluid velocity, the more different is the operating condition of the turbine from the nominal one. The centrifugal forces shape the surfaces of the stream of the working fluid into a hyperboloid of rotation, which is assisted by the diffuser effect due to the outwardly tapering shape of the guide. Consequently, in the area of the roots of the blades of the runner, adjoining the inlet of the exhaust pipe, the working fluid stream breaks away off the inner wall of the exhaust pipe, and circulation zones develop, i.e. the zones where the working fluid flows along closed surfaces which are asymmetric with respect of the axis of the turbine, these circulation zones tending to extend as far as into the runner of the turbine's last stage under some operating conditions of the latter.

In this case each blade of the runner successively passes segments with different values of the flow rate by volume of the working fluid in the course of its each revolution, whereby each blade is acted upon by a varying bending effort applied by the working fluid flow. This results in an alternating strain of the blades of the runner and, hence, their eventual untimely fatigue-caused breakdown.

Moreover, the abovementioned circulation zones in the exhaust pipes of steam turbines have been found to cause ingress of water particles, i.e. droplets, from the outlet portion of the exhaust pipe into the runner blade area. This, in its turn, results in the downstream edges of the runner blades becoming eroded away, whereby the cross-sectional area of the blades is reduced and its shape distorted, which further accelerates dangerous conditions, to say nothing of the economy of the operation of the turbine last stage being impaired.

It should be also mentioned that the said circulation zones more often than not are disposed asymmetrically with respect of the axis of the turbine, so that they alter the character of the flow of the working fluid around each blade of the runner in the course of each rotor revolution, which causes additional energy losses in the runner because of the so-called non-stationary character of the flow.

OBJECTS AND SUMMARY OF THE INVENTION

The present invention has for its object the creation of an exhaust pipe of a turbine having a guide of a structure providing for axisymmetric flow of the working fluid through the inlet portion of the exhaust pipe, whereby the development of circulation zones at various operating duties of the turbine is eliminated.

This object is attained in an exhaust pipe of a turbine, accommodating in the inlet portion thereof a guide defining an inner side surface which is essentially the surface of a body of revolution about a longitudinal axis coincident with the axis of the turbine, and so disposed that one of its end adjoins the outer ends of the blades of the runner of the turbine, in which exhaust pipe, in accordance with the invention, the guide is adapted to vary the area of the flow cross-section of the inlet portion of the exhaust pipe.

This construction provides for maintaining an asymmetric flow of the working fluid and for the elimination of circulation zones within the inlet portion of the exhaust pipe and within the last stage of the turbine.

It is inferred that the guide should include telescopically interconnected elements and should be associated with an actuator adapted to spread these elements in a direction away from the blades of the runner, axially of the turbine, the actuator being operatively connected with the element which is most remote from the blades of the runner in the spread state of the guide, to vary the area of the flow cross-section of the inlet portion of the exhaust pipe.

This construction improves the stability of the flow of the working fluid under various operating conditions of the turbine, as a result of the inner surface of the guide being of a variable length axially of the turbine.

It is also preferred that the guide be shaped as a cylinder ending in an inclined plane and associated with an actuator for adjusting the guide axially and/or circumferentially, to vary the area of the flow cross-section of the inlet portion of the exhaust pipe.

This construction is exceedingly simple and dependable, while providing for varying the circumferential arrangement or disposition of the portions of the inner surface of the guide, having different lengths, under varying operating conditions of the turbine, and thus for minimizing the axial asymmetry of the flow within the inlet portion of the exhaust pipe and for eliminating circulation zones within this portion, whereby the reliability and economic ratings of the turbine are enhanced.

It is also preferred that the guide be made up of plate-like elements arranged along the generatrix thereof, the elements partly overlapping one another and being operatively connected with actuator means adapted to spread the elements in a fan-like fashion, to vary the area of the flow cross-section of the inlet portion of the exhaust pipe.

This construction is particularly effective in exhaust pipes having a tapering inlet portion and provides for significantly broadening the range of the flow patterns within the last turbine stage and within the inlet portion of the exhaust pipe, characterized by the absence of circulation zones, as compared with the abovespecified embodiments, which further enhances the reliability and economy ratings of the turbine.

It is likewise preferred that the guide be made up of elements successively arranged circumferentially thereof and operatively connected with actuator means adapted to rotate the elements radially, to vary the area of the flow cross-section of the inlet portion of the exhaust pipe.

This construction additionally provides for the economy ratings of the exhaust pipe at the nominal operating duty, owing to the possibility of turning the elements making up the guide into a position optimizing the working fluid flow through the inlet portion of the exhaust pipe. In this case these elements serve as guide vanes optimizing the transition of the flow from its radial motion at the inlet portion of the exhaust pipe to the motion toward the outlet of the exhaust pipe.

The herein disclosed constructions of an exhaust pipe of a turbine, while not impairing the economy ratings of the exhaust pipe at the nominal duty, enable to vary the flow cross-section of the inlet portion thereof to conform to the varying operating condition of the turbine, and thus to avoid non-asymmetry of the flow and to preclude circulation zones tending to affect the reliability and economy of the turbine.

Axial symmetry of the working fluid flow eliminates the additional alternating strain of the runner blades and the additional energy losses in the turbine, while the absence in circulation zones of the flow at the blades of the runner precludes the eroding of their outlet edges. Thus, the present invention prolongs the life of the turbine blades, curbs down the emergency hazard, reduces the maintenance costs of the turbine rotor and steps up the efficiency factor, i.e., improves the economy ratings of the turbine within a broad range of operating conditions.

Other objects and advantages of the invention will become apparent from the following description of its exemplary embodiments and from appended drawings.

BEST MODE FOR CARRYING OUT THE INVENTION

Figure 1:
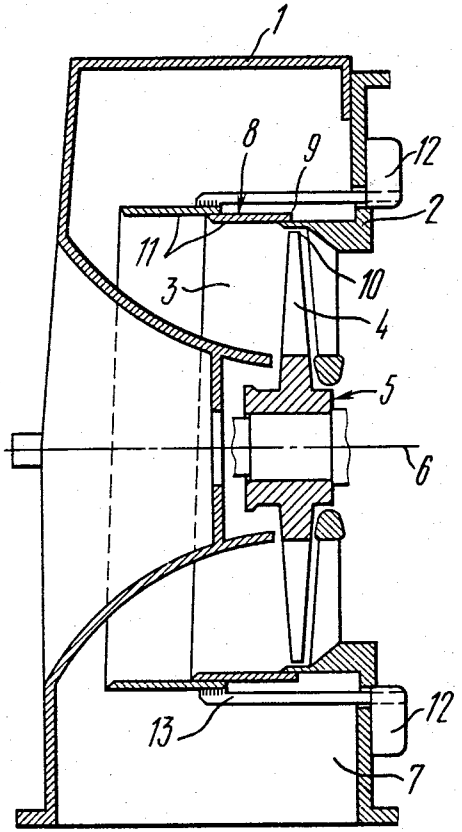
FIG. 1 is a schematic longitudinal sectional view of the exhaust pipe of a turbine in accordance with the invention, in an embodiment where the guide is made up of telescopically interconnected elements.

FIG. 1 shows an exhaust pipe for a turbine having a stationary housing 1 fast with the stator structure 2 of the turbine. The housing 1 of the exhaust pipe includes an inlet portion 3 disposed downstream of the blades 4 of the runner 5 of the last stage of the turbine. The housing 1 is curved guide the working fluid emerging substantially along the axis 6 of the turbine from the runner 5 toward the outlet portion 7 of the exhaust pipe.

The inlet portion 3 of the exhaust pipe is encompassed by a guide 8 defining an inner side surface which is essentially the surface of a body of revolution about an axis coincident with the axis 6 of the turbine, which surface in the presently described embodiment is cylindrical.

The guide 8 is mounted so that one of its end 9 adjoins the outer ends 10 of the blades 4 of the runner 5. In the presently described embodiment this end 9 of the guide 8 extends beyond the external ends 10 of the blades 4, enclosing the runner 5 therein.

In accordance with the present invention, the guide 8 is adapted to vary the flow cross-section of the inlet portion 3 of the exhaust pipe.

In the embodiment shown in FIG. 1, the guide 8 is made up of cylindrical elements 11 telescopically interconnected with each other. The guide 8 is associated with an actuator 12 adapted to spread or extend the elements 11 in the direction away from the blades 4 of the runner 5, longitudinally of the axis 6, or else to retract the elements 11 into each other, depending on the varying operating condition of the turbine. That one of the elements 11 which is the most remote from the blades 4 with the guide 8 in the extended position is operatively connected with the actuator 12.

The actuator 12 is rigidly secured to the stator structure 2 by any suitable known means and in the presently described embodiment includes an electric motor of a known per se structure which is not described here in detail, for the sake of brevity. Alternatively, the actuator may be a hydraulic or pneumatic one, or of any other suitable known per se structure. The actuator 12 is operable not only for full extension of the elements 11, but also for their limited extension; i.e. it is operable for controllable variation of the area of the flow cross-section of the inlet portion 3 of the exhaust pipe. In the presently described embodiment there are four such actuators 12 uniformly spaced about the circumference of the guide 8 and operatively connected with the elements 11; however, in practical embodiments this number may be different.

The operative connection of the element 11 which is the most remote one from the blades 4 in the extended or spread state of the guide 8 with the actuator 12 includes a rack-and-pinion transmission comprising the rod 13 acting as a toothed rack secured to the element 11, e.g. by welding, and extending parallel with the axis 6 of the turbine. In the embodiment described there are two elements 11, however, their number may be greater than two.

Figure 2:
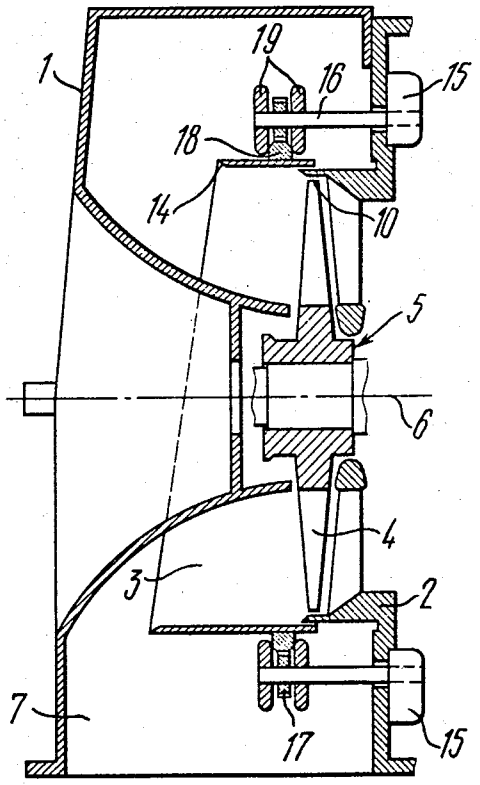
FIG. 2 shows the same, as FIG. 1, but in an embodiment where the guide includes a cylinder terminated by an inclined plane.

In another embodiment of the invention, illustrated in FIG. 2, the inlet portion 3 of the exhaust pipe accommodates a guide 14 which is a cylinder terminated by an inclined plane; in other words, the guide 14 has a circumferentially varying axial length.

The guide 14 is operatively connected with an actuator 15 secured to the stator structure 12 by any suitable known per se means and including in this embodiment an electric servomotor and a gearing of any suitable known per se structure. The actuator 15 is operable to adjust the guide 14 axially and/or circumferentially, to vary the area of the flow cross-section of the inlet portion 3 of the exhaust pipe.

The operative connection between the actuator 15 and the guide 14 includes a rod 16 extending parallel with the axis 6 of the turbine in the form of a toothed rack. By switching over the mode of the performance of the gearing (not shown) of the actuator 15 in accordance with the varying working load of the turbine, the rod can be rotated about its longitudinal axis and/or moved therealong.

The rod 16 has fixedly mounted thereon a pinion 17 meshing with a toothed rim 18 secured about the outer side surface of the guide 14, for rotating the guide 14 about its axis 6.

The rod 16 further has fixedly mounted thereon, to both sides of the pinion 17, thrust discs 19 adapted to cooperate with the toothed rim 18, with the respective end face surfaces of the discs 9 abutting against the end face surfaces of the toothed rim 18 to move the guide 14 longitudinally of the axis 6 in either direction.

Thus, by varying the axial and circumferential position of the guide 14, it is possible to vary both the value and configuration of the flow cross-section of the inlet portion 3 of the exhaust pipe, which eliminates axial asymmetry of the flow of the working fluid at various operating duties of the turbine.

The number of the actuators 15 uniformly spaced about the circumference of the guide 14 is four in the embodiment described; however, it may be different, e.g. greater than four.

Figure 3:
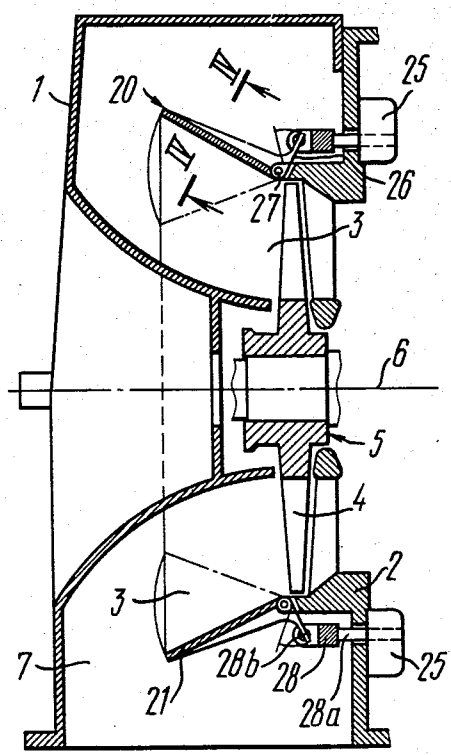
FIG. 3 is a schematic longitudinal sectional view of the exhaust pipe of a turbine in accordance with the invention, in an embodiment where the guide is made up of elements arranged along the generatrix thereof and partly overlapping one another.
Figure 4:
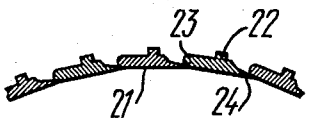
FIG. 4 is a sectional view taken on line IV—IV of FIG. 3.

In still another embodiment of the present invention, illustrated in FIG. 3, the inlet portion 3 of the exhaust pipe accommodates a guide 20 (FIG. 3) having a tapering inner side surface and being made up of a plurality of platelike elements 21 (FIGS. 3 and 4) partly overlapping one another. These elements 21, as it can be seen in FIGS. 3 and 4, are plates having each a substantially flat inner side surface facing the axis 6. The outer side surface of each element 21 has a square rib 22 made thereon, integral with the element 21, to act as a rigidity rib.

The extremities 23 of the elements 21, which are the left-hand ones in FIG. 4, are enlarged to enhance the rigidity of the elements 21, while the opposite, right-hand extremities 24 are slantingly pointed to better underlie the respective enlarged extremities 23 of the adjacent elements 21. Secured to the stator structure 2 by any suitable known means are actuators 25 which in the embodiment being described are electric servomotors. Each actuator 25 is operatively connected with lugs 26 of the elements 21, shaped as arms extending normally to the inner side surfaces of the respective elements 21. Each element 21 has its portion of junction with the lug 26 pivotally connected to the stator structure 2 of the turbine by means of a pivot 27 with one degree of freedom, of any suitable known structure which need not be described here in detail. The dash-and-dot lines in FIG. 3 indicate the pivoted position of the elements 21, attained by pivoting the elements 21 about the axes of their pivots 27. Simultaneous pivoting of all the elements 21 enables to alter the cross-sectional flow area of the inlet portion 3 of the exhaust pipe.

The operative connection of the actuators 25 with the lugs 26 is effected by means of a ring 28 whose axis is coincident with the axis 6 of the turbine. A rod **28*a* is secured to the right-hand (in FIG. 3) face of the ring 28, for operative connection with the respective actuator 25, so that the ring 28 can be actuated axially of the turbine. At the opposite, left-hand side the ring 28 is operatively connected with the lug 26 of each respective element 21 with aid of a pivot 28*b* with two degrees of freedom providing for relative rotation and translation of the lug 26 and ring 28. The pivot 28*b*** is of any suitable known per se structure which is not described here in detail for the sake of brevity.

Although this embodiment of the exhaust pipe is structurally more sophisticated that the aforementioned embodiments, on account of the guide 20 comprising, preferably, at least twenty-four elements 21, it is, nevertheless, of significant merits when the inlet portion 3 of the exhaust pipe has been designed to correspond to the flow of the working fluid along tapering flow surfaces.

Figure 5:
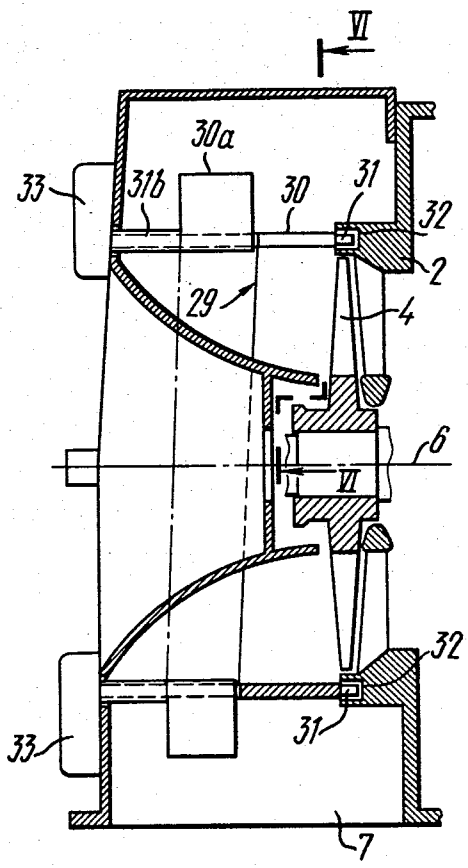
FIG. 5 is a schematic longitudinal sectional view of the exhaust pipe of a turbine in accordance with the invention, in an embodiment where the guide is made up of elements successively arranged circumferentially thereof.
Figure 6:
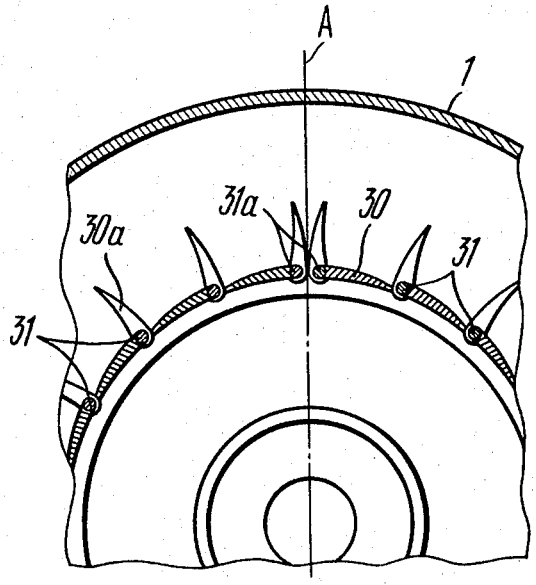
FIG. 6 is a sectional view taken on line VI—VI of FIG. 5.

In yet another embodiment of the present invention illustrated in FIG. 5, the inlet portion 3 of the exhaust pipe accommodates therein a guide 29 made up of elements 30 and **30*a* which are aerodynamically convex-concave in cross-section, as shown in FIG. 6. The elements 30 and 30*a* are successively arranged circumferentially of the guide 29, with the concave surface of each element 30 and 30*a* being cylindrical and presenting a portion of the inner cylindrical surface of the guide 29**.

The thicker extremities of the elements 30 and **30*a* are secured, as shown in FIG. 6, on pins 31 extending along the cylindrical side surface of the guide 29 parallel with the axis 6 and journalled in the stator structure 2. In the lefthand (in FIG. 6) and right-hand parts of the exhaust pipe the pins 31 are disposed symmetrically with respect of the vertical plane A of symmetry of the housing 1 of the exhaust pipe. In each one of said parts the centre of the pin 31*a* which is the top-most one in FIG. 6 is spaced from this plane A of symmetry by an extent substantially equal to one half of the thickness of the enlarged extremity of the element 30. The other, intermediate pins 31 extend along the respective generatrices of the guide 29, at spaces, starting from the pin 31*a*, equalling the widths of the respective elements 30**.

The right-hand (in FIG. 5) ends of the pins 31 are journalled in bearings 32 integral with the stator structure 2 of the turbine, each bearing 32 in the presently described embodiment being a cylindrical bore. The left-hand (also in FIG. 5) end of each pin 31 is operatively connected with its respective actuator 33, e.g. through a toothed gearing (not shown).

Each actuator 33 is secured externally of the housing 1 of the exhaust pipe by suitable known means and in the embodiment described includes an electric sevomotor and a reducing gear of a known per se structure, not described here in detail for the sake of brevity may be hydraulically or pneumatically operated, and may have other types of gearing transmitting rotation to the pins 31.

In the presently described embodiment of the exhaust pipe the respective numbers of the elements 30, **30*a* and actuators 33** are equal to each other.

The elements **30*a* making up the series remote from the blades 4 have hollow tubular axles receiving therein pins 31 projecting therefrom by an extent in excess of the axial dimension or length of the respective element 30. The elements 30 and 30*a* are rotatable independently of each other. FIGS. 5 and 6 show one adjusted position of the guide 29, where the elements 30 extend along its generatrix, while the elements 30***a* has been rotated substantially radially of the axis 6. The actuator 33 is of a structure enabling to retain the elements 30 and 30*a* in any intermediate position, i.e. partly rotated from the abovespecified attitudes. The dash-and-dot line 34 in FIG. 5 shows the maximum length of the guide 29, where both the elements 30 and 30*a* extend along its generatrix.

This construction of the guide 29 enables to enhance the economy of the exhaust pipe and of the turbine, as well as the latter's reliability within a wide range of operating conditions, the nominal one included; however, it requires a greater number of actuators and is more complicated in operation than the aforedescribed embodiments.

The exhaust pipe of a turbine in accordance with the present invention, in the embodiment illustrated in FIG. 1 operates as follows.

With the turbine operating with the maximum power output, i.e. with the maximum flow rate by volume of the working fluid flowing to the left in FIG. 1 and emerging from the blades 4 of the runner 5, it is expedient to maintain the minimum pressure of the working fluid in the inlet portion 3 of the exhaust pipe. This is attained by actuating both elements 11 of the guide 8 into the extreme right-hand position in FIG. 1, which is the initial or fully retracted position.

With a reduced power output of the turbine, when the flow rate by volume of the working fluid through the blades 4 of the runner 5 is short of the nominal, while the angular speed of the runner 5 is substantially at the same level, the working fluid entering the inlet portion 3 of the exhaust pipe has significant circumferential and radial components of its velocity, with the radial component directed away from the axis 6 of the turbine and being the greater, the greater is the circumferential component, i.e. the more swirling is the flow.

With the swirling flow in the inlet portion 3 of the exhaust pipe, when this inlet portion is not externally limited by a solid cylindrical surface, the pressure at the roots of the blades 4 of the runner 5 becomes so reduced that some fraction of the flow of the working fluid returns from the outlet portion 7 of the exhaust pipe back to the blades 4. The interaction of the main and back flows develops in the hitherto known structures closed circulation zones which narrow down the flow section of the main flow, asymmetrically with respect of the axis 6 of the turbine, because of the asymmetric construction of the exhaust pipe. Therefore, a non-uniform field of parameters is developed in the inlet portion 3. While intersecting this field during their each successive revolution about the axis 6, the blades 4 are subjected to a cyclically varying load, at a frequency equal to or being an integer of the frequency of rotation of the runner 5.

To avoid this alternating strain on the blades 4, the actuators 12 are energized either automatically or by the operator of the turbine, whereby the rods 13 are moved to the left (in FIG. 1) at the same rate, to displace the greater-diameter element 11 from the fully retracted position. With the element 11 of the slightly greater diameter (owing to its telescopic connection with the element 11 of the slightly smaller diameter) fully extended, the other element 11 is likewise extended to the left, into the fully extended position of the guide 8, illustrated in FIG. 1.

In this position of full extension the actuators 12 are deenergized automatically. However, the extension of the elements 11, and their retraction, may be terminated in any intermediate position, to maintain the optimum pattern of the flow within the inlet portion 3 of the exhaust pipe at various flow rates of the working fluid.

The cylindrical inner surface of the guide 8 brings down the radial component of the working fluid velocity. With the guide 8 extended, the inlet portion 3 has the shape of a confuser, i.e. the cross-sectional flow area at its outlet is smaller than at its inlet. Therefore, the pressure of the working fluid at the outlet of the inlet portion 3 is at least not in excess of the pressure at the base of the blades 4. Thus, there is avoided the eventuality of developer's back flows of a considerable intensity, of circulation zones within the inlet portion 3 of the exhaust pipe, of additional dynamic loads and of eroding blades 4. Owing to the greater uniformity of the field of the parameters of the working fluid downstream of the blades 4, and to the absence of a considerable radial component of the working fluid velocity, the economy ratings of the operation are enhanced, at least, as far as the last stage of the turbine is concerned.

The exhaust pipe illustrated in FIG. 2 operates as follows.

With the turbine running at the nominal duty, the guide 14 is at the extreme right-hand position.

Some axial asymmetry of the parameter field downstream of the blades 4 can be either partly or completely eliminated by rotating the guide 14 into the appropriate angular position. This is done by simultaneously energizing all the actuators 15 either automatically or manually for rotating the rods 16 in the same direction, whereby the pinions 17 rotate the toothed rim 18 together with the guide 6 through a corresponding angle about the axis 6, whereafter the actuators 15 are deenergized.

Under conditions accompanied by a swirling flow within the inlet portion 3 of the exhaust pipe, the actuators 15 are energized for simultaneously displacing the rods 16 axially to the left.

The respective thrust discs 19 bear by their end faces upon the end face surfaces of the toothed rim 18, to move the latter with the guide 14 to an appropriate extension along the axis 6, whereafter the actuators 15 are deenergized.

In each adjusted axial position of the guide 14, its angular position is corrected by energizing the actuators 15 to rotate the rods 16.

Thus, notwithstanding the small amount of the component parts, i.e. the simplicity of the manufacture, this construction enables to adjust within a broad range the flow cross-section of the inlet portion 3 of the exhaust pipe, and thus to preclude the development therein of circulation zones.

The exhaust pipe illustrated in FIGS. 3 and 4 operates as follows.

Under normal operation of the turbine, the guide 20 is in the initial position shown in FIG. 3. Its inner side surface is essentially the surface of a truncated cone, flaring in the direction of the working fluid flow, i.e. to the left in FIG. 3 while the entire inlet portion 3 of the exhaust pipe functions as an annular tapering diffuser reducing the velocity of the working fluid and building up its pressure.

While lower flow rates of the working fluid, and with the latter's flow deflecting from the axial direction, the flow through this annular diffuser attains a breakaway character, as it has been described hereinabove. The actuators 25 are thus energized either manually or by an automatic system (not shown) to actuate the rods 28*a* to move the ring 28 to the left in FIG. 3. With the lug 26 of each element 21 of the guide 20 connected with the ring 28 through a respective pivot 28*b* with two degrees of freedom, i.e. with provisions for relative rotation about one axis and relative translation along another axis, normal to the first one, this connection ensures that with the ring 28 moving axially, the elements 21 rotate simultaneously about the axes of the pivots 27 with a single degree of freedom, connecting the elements 21 with the stator structure 2. This rotation alters the inclination of the inner surface of the guide 20 relative to the axis 6 in meridian planes, so that this surface can be transformed from the flaring one into one constricting in the direction of the major flow of the working fluid (as shown with dash-and-dot lines in FIG. 3). The relative mobility of the elements 21 is provided for by the elements 21 successively overlapping one another as they are folded in fan-like, fashion owing to the pointed shape of their right-hand extremities in FIG. 4 facilitating this overlapping without disrupting the engagement.

This alteration of the shape of the inner surface of the guide 20 significantly broadens the range of the adjustment of the flow cross-section of the inlet portion 3 of the exhaust pipe, and, hence, the range of operating duties whereat the stable performance of the last stage is maintained. The inclination of the inner surface of the guide 20 toward the axis 6 of the turbine makes the meridian lines of the flow likewise deflect toward the axis 6, which precludes the breakaway of the flow in the blades 4 and enhances the economy ratings and reliability of the turbine.

The exhaust pipe illustrated in FIGS. 5 and 6 operates as follows.

Under normal or nearly normal conditions, the elements 30 and 30*a* are set into essentially radial positions, i.e. they perform the function of adjustable guide vanes of a vane diffuser enhancing the process of increasing the pressure of the working fluid, as the latter flows radially outwardly, to be subsequently guided in one and the same direction, as is the case in the presently described exhaust pipe where the working fluid is guided toward the exit portion 7.

Under transient conditions, to maintain the stability of the flow through the inlet portion 3 of the exhaust pipe, the actuators 33 are operated to rotate the pins 31 together with the series of the elements 30, for the latter to attain a position normal to the radial one, shown in FIG. 6, i.e. for the inner concave surfaces of the elements 30 to close into the common cylindrical inner surface. If the axial length of the guide 29 proves inadequate, the actuators 33 are operated to rotate in a similar way the elements 30*a*, with aid of the axles 31*b* (as shown with dash-and-dot lines in FIG. 5).

This construction of the exhaust pipe wherein the guide is transformable into an adjustable vane-type diffuser renders the exhaust pipe highly efficient throughout the operating range of the turbine, enhances the economy ratings and reliability of the last stage of the turbine, and of the turbine, as a whole.

The exhaust pipe of the invention has been thoroughly tested under actual use conditions and has been found to be completely successful for the accomplishment of the above-stated objects of the invention.

INDUSTRIAL APPLICABILITY

The present invention can be utilized to utmost effectiveness in axial-flow turbines with non-axisymmetric exhaust of the working fluid.

The invention can be profitably utilized in steam and gas turbines intended to drive power generators, air blowers, ship propellers and the like, i.e. operable with variable flow rates of the working fluid and variable angular speed of the rotor.

What is claimed is:

1. An exhaust pipe of a turbine having in the inlet portion thereof a guide defining the inner side surface of said pipe and which is essentially the surface of a body of revolution about a longitudinal axis coincident with the axis of said turbine, and so disposed that one its end adjoins the outer ends of the blades of the runner of the turbine, said guide being movable to vary the area of the flow cross-section of the inlet portion of said exhaust pipe.

2. An exhaust pipe for a turbine, as claimed in claim 1, wherein said guide includes:

telescopically interconnected elements, actuator means adapted to spread or extend these elements in a direction away from the blades of the runner turbine, longitudinally of the axis of the turbine, operatively connected with the element which is the one most remote from said exhaust pipe.

3. An exhaust pipe for a turbine, as claimed in claim 1, wherein:

said guide is shaped as a cylinder terminated by an inclined plane and operatively connected with actuator means for adjusting said guide axially and/or circumferentially, to vary the area of the flow cross-section of the inlet portion of said exhaust pipe.

4. An exhaust pipe for a turbine, as claimed in claim 1, wherein:

said guide is made up of plate-like elements arranged along the generatrix thereof;

said elements partly overlapping one another and being operatively connected with actuator means adapted to spread said elements in fanlike fashion, to vary the area of flow cross-section of the inlet portion of said exhaust pipe.

5. An exhaust pipe for a turbine, as claimed in claim 1, wherein:

said guide is made up of elements successively arranged circumferentially thereof and operatively connected with actuator means adapted to rotate the elements radially, to vary the area of the flow cross-section of the inlet portion of said exhaust pipe.

6. The exhaust pipe of claim 5, wherein:

said elements are convex-concave in cross-section, the concave surface of each element being cylindrical.

7. The exhaust pipe of claim 5, wherein:

said elements have a thicker extremity and said extremity is secured to said guide by pins.

8. The exhaust pipe of claim 7, wherein:

one end of said pins is journalled in a bearing integral with the stator structure of said turbine.

9. The exhaust pipe of claim 8, wherein said pins are operatively connected to said actuator means.

10. The exhaust pipe of claim 9, wherein said activator means is a servomotor.

11. The exhaust pipe of claim 7, wherein said pins are operatively connected to said actuator means.

12. The exhaust pipe of claim 11, wherein said activator means is a servomotor.

13. An exhaust pipe of a turbine having in the inlet portion thereof a guide for adjusting the free passage area of said inlet portion and defining the inner side surface of said pipe, said guide being essentially the surface of a body of revolution about a longitudinal axis coincident with the axis of said turbine, and so disposed that one of its ends adjoins the outer ends of the blades of the runner of the turbine, said guide being movable to vary the area of the flow cross-section of the inlet portion of said exhaust pipe.

14. An exhaust pipe for a turbine as claimed in claim 13 wherein said guide includes:

telescopically interconnected elements, actuator means rigidly secured to the stator of the turbine adapted to spread or extend these elements in a direction away from the blades of the runner turbine, longitudinally of the axis of the turbine, operatively connected with the element which is the one most remote from said exhaust pipe.

15. An exhaust pipe as claimed in claim 14, wherein said elements are cylindrical.

16. An exhaust pipe for a turbine as claimed in claim 13 wherein:

said guide is shaped as a cylinder and has a circumferentially varying length operatively connected with actuator means for adjusting said guide axially and/or circumferentially, to vary the area of the flow cross-section of the inlet portion of said exhaust pipe.

17. An exhaust pipe for a turbine as claimed in claim 16 wherein the end with the circumferentially varying length is terminated by an inclined plane.

18. An exhaust pipe for a turbine as claimed in claim 13 wherein:

said guide has a tapering inside surface and is made up of plate-like elements arranged along the generatrix thereof;

said elements each having a substantially flat inner side surface facing said turbine axis; and said elements partly overlapping one another and being operatively connected with an actuator means adapted to spread said elements in fanlike fashion, to vary the area of flow cross-section of the inlet portion of said exhaust pipe.

19. An exhaust pipe for a turbine as claimed in claim 18 wherein the outer surface of each said element has a square rigidity rib inegral therewith, one end of said elements being enlarged for enhanced rigidity, and the other ends of said elements being slantingly pointed.

20. An exhaust pipe for a turbine as claimed in claim 13 wherein:

said guide is made up of two groups of elements successively arranged circumferentially thereof and operatively connected with actuator means adapted to rotate the elements radially, to vary the area of the flow cross-section of the inlet portion of said exhaust pipe, each of said group of elements being rotatable independently of the other; and one of said group of elements being remote from the rotor of the turbine and have hollow tubular axles receiving therein pins projecting therefrom by an exhaust in excess of the axial dimension of a respective element of said other group of elements, said one group of elements extending along its generatrix and the other group of said elements being rotated substantially radially of said axes.

* * * * *